United States Patent [19]

Mott

[11] 4,004,531

[45] Jan. 25, 1977

[54] DRILLING SYSTEM FOR DEEP WATER OFFSHORE LOCATIONS

[75] Inventor: George E. Mott, Metairie, La.

[73] Assignee: Texaco Inc., New York, N.Y.

[22] Filed: Oct. 3, 1975

[21] Appl. No.: 619,346

Related U.S. Application Data

[63] Continuation of Ser. No. 470,685, May 16, 1974, abandoned.

[52] U.S. Cl. ..... 114/256

[51] Int. Cl.[2] ..... B63B 35/44

[58] Field of Search ..... 114/.5 D; 61/46.5; 175/5, 7–9

[56] References Cited

UNITED STATES PATENTS

| | | | |
|---|---|---|---|
| 2,777,669 | 1/1957 | Willis et al. | 14/.5 D |
| 3,299,846 | 1/1967 | Jarlan | 114/.5 D |
| 3,470,838 | 10/1969 | Daniell | 114/.5 D |
| 3,824,943 | 7/1974 | Mo | 114/.5 D |

*Primary Examiner*—Trygve M. Blix
*Assistant Examiner*—Stuart M. Goldstein
*Attorney, Agent, or Firm*—T. H. Whaley; C. G. Ries; Robert B. Burns

[57] ABSTRACT

A system for drilling and for producing subsea wells in relatively deep waters normally subjected to severe wave and current conditions. A floating drilling vessel or production unit is maintained in position over the well site. A riser pipe, maintained under constant tension, depends from the drilling or production vessel downwardly to and operably engages a well head. An elongated caisson depends from the drilling or production vessel to form a protective area about the riser pipe upper end. As a result, stresses induced in the riser pipe upper end by wave and current forces acting on the riser are thereby greatly reduced.

11 Claims, 5 Drawing Figures

DRILLING SYSTEM FOR DEEP WATER OFFSHORE LOCATIONS

This is a continuation of application Ser. No. 470,685, filed May 16, 1974, and now abandoned.

BACKGROUND OF THE INVENTION

In the drilling or producing of subsea offshore wells, particularly in deep waters, several operating conditions are necessary. First, the drilling or production ship or vessel must be continuously maintained approximately over the drill or well site in spite of prevailing surface conditions. Secondly, the elongated mud riser or production riser which communicates the vessel with the well head must be maintained relatively straight and is therefore constantly uder tension. This riser is maintained in the state of tension by either an active or passive system during the drilling or producing operation. Thus the riser maintains a substantially static condition in spite of movement of the vessel, whether laterally or in a vertical direction.

In the instance of the drilling riser, tension is normally applied to the upper end thereof from suitable active tensioning apparatus carried on the drilling vessel. The usual apparatus for the purpose is responsive to any movement of the vessel. Thus, in effect both the upper and lower ends of the riser are axially tensioned, even though pivotally connected. The remainder of the riser is subjected to both bending and axial stresses.

In the instance of the production riser one or both ends of the unit can be fixed against rotation in order to eliminate maintenance problems on underwater pivotal joints.

In both the drilling and production risers, a telescoping joint is provided at either the top or the bottom of the unit to permit the vessel to move without inducing additional stresses into the riser. This arrangement assures that tension in the riser will be maintained constant regardless of the complex motions to which the surface vessel is ordinarily subjected under severe weather conditions.

In one form of marine drilling vessel, notably the semisubmersible type, the effects of weather conditions on the vessel's motions are minimized by the vessel's wave transparent structure. Thus, in the ordinary semisubmersible unit, the vessel support elements comprise a plurality of upstanding column-like members which support the working deck above the water's surface. Said upstanding members are controllably buoyant to regulate the vessel's vertical orientation in the water.

This type of vessel has been found to operate with particular effectiveness in harsh environments characterized by the North Sea area. In such areas, a prevailing problem is the severe wind, waves and currents which disrupt drilling or producing operations due to stress limitations in the risers. While normal drill ships experience considerable down time as a result of excessive motions of the ship in a harsh environment, in the instance of semisubmersible vessels, the wave transparent structure assures a minimal amount of resistance to waves.

Understandably then, under aggravated storm conditions the motion of the vessel will be greatly reduced. Thus, while the structure remains relatively stable in the water, the waves will tend to pass through the support columns and exert only a limited lateral force thereon. However, even with semisubmersible vessels considerable down time or non-operating time is experienced due to the weather at such time as the risers become overstressed, as for example when waves achieving approximately 30 to 35 feet in height are present.

Semisubmersible vessels of the type contemplated are normally maintained in position by anchoring rods extending outward and downward from the vessel to the ocean floor. Thus, although the vessel will be deflected somewhat from its position in response to the force of wind, waves and current, such deflection will be minimized. Maintaining the mud riser in the desired condition then will be readily achieved for either drilling or producing operations.

Another type of vessel which offers great potential in deep water is the tension leg platform. This structure is similar in many respects to the semisubmersible type vessel above mentioned. The mooring lines on the tension leg unit, however, extend vertically, instead of with the normal catenary used in conventional mooring processes. By ballasting the vessel to the desired degree the mooring lines can be maintained under constant tension. Thus, heave, roll and pitch of the vessel are virtually eliminated.

Although this tension leg type vessel will permit personnel to continue working under more severe sea conditions than either a conventional ship or semisubmersible vessels, it will nonetheless also be subjected to considerable down time due to weather prompted by the stress limitations of the drilling or production risers.

Considering the ordinary profile of an ocean wave, particularly when generated under storm conditions, the maximum lateral force of the wave will be exerted near the wave surface. This force will progressively decrease with the depth of the water. The same type lateral force profile is exhibited by ocean currents during storms and the like.

It has been demonstrated that mooring systems on semisubmersible vessels can be adequately designed to maintain the latter on location even during the most severe storms with the rig being little affected. In contrast, however, the effect of storm waves and currents on the mud riser is so severe that it is found impossible to maintain the risers connected to blowout preventers or the like during extreme stormy conditions. Breaking risers can be both expensive and time consuming, which characteristics in the instance of offshore operations, are considered synonymous.

Toward overcoming this concentration of stress in the mud riser during stormy conditions, a drilling system is provided as herein described, for operating in deep offshore waters. Said system is particularly adapted to permit the vessel to function continuously in spite of the water conditions.

The drilling rig comprises normally a semisubmersible or tension leg type of drilling or production vessel as herein mentioned. Said rig includes pipe drilling or production risers extending downwardly therefrom and function to protect the drill string, as well as to conduct drilling mud or oil and gas between the vessel and a well. The elongated riser extending from the blowout preventer or well head to the vessel, is fastened at opposite ends. It is further tensioned at the upper end to permit drilling and/or producing operations to continue under all circumstances.

To minimize the stress induced into the riser during severe turbulent water conditions, a downwardly extending rigid caisson depends from the drilling or production vessel. Said caisson encloses the upper segment of the riser along that length thereof most susceptible to high stress concentrations. The caisson thus forms a confined though open area about the riser, permitting a liberal degree of riser deflection as the semisubmersible adjusts its position. However, the sytem allows for free movement of the blowout preventer and well head equipment through the caisson at such times as the latter must be raised or lowered.

Figure 1:
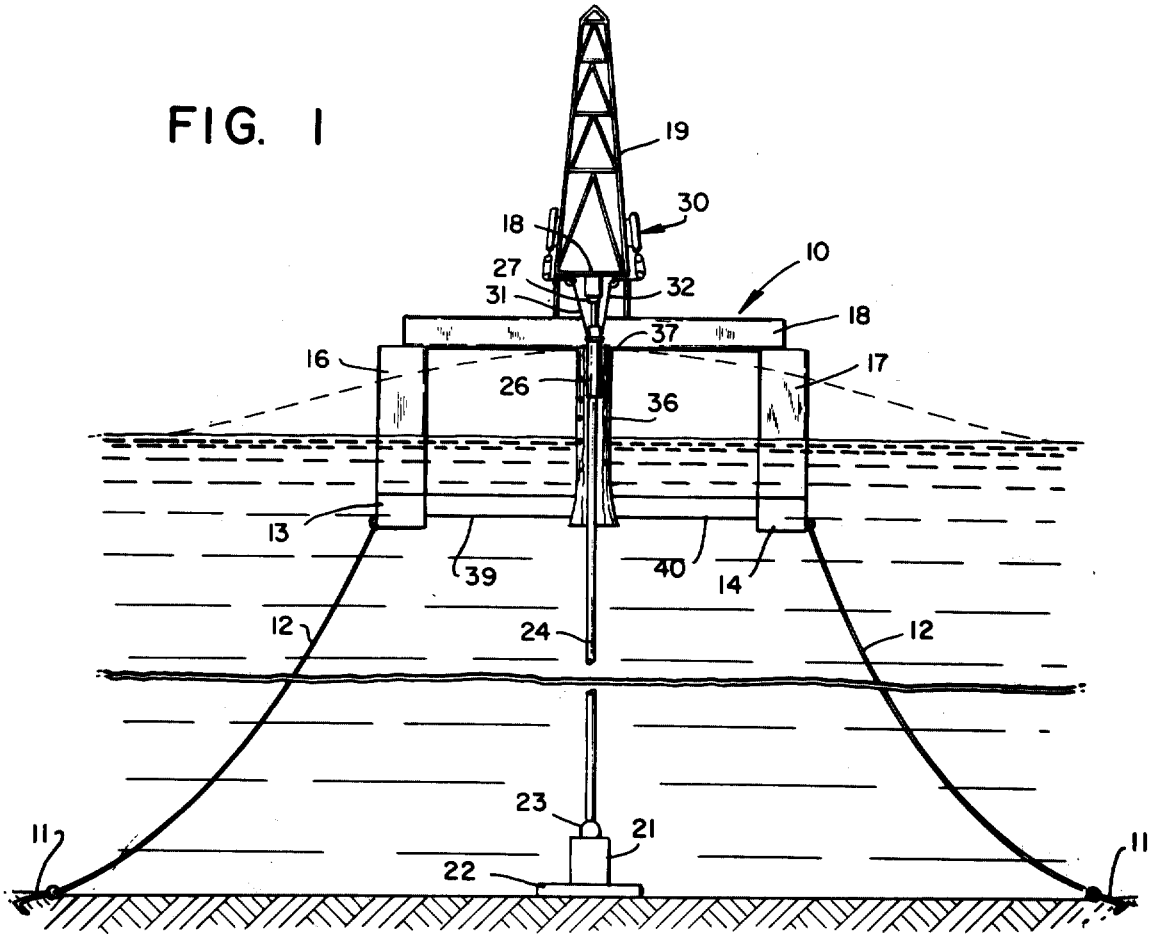
FIG. 1 represents a vertical elevation of a semisubmersible drilling vessel of the type contemplated positioned over a well in an offshore body of water.

In the drawings, the system generally contemplated is shown in FIG. 1. The system includes a semisubmersible drilling vessel 10 of the type adapted to be floated to an offshore position and thereafter, in a partially submerged condition, be fixed by the placement of a number of anchors 11 and anchor lines 12. These anchors are normally disposed about the vessel in sufficient number to withstand the normal displacing forces exerted by the elements at the drilling site.

In this type drilling vessel, the hull portion comprises at least one and preferably a plurality of elongated horizontal buoyancy members 13 and 14 disposed at the lower end thereof. A plurality of upstanding columns or vertical members 16 and 17 extend from the hull and terminate at a position above the water's surface. The upper end of said vertical columns functions to support a drilling deck and other structural elements which from a part of the vessel.

In the normal manner, vessel 10 is provided with the necessary accouterments for performing a drilling operation at an offshore body of water. As a rule such apparatus includes a derrick 19 positioned preferably centrally of the vessel and having means to raise and lower the drill string as it bores a well. The vessel also contains the necessary draw works, crew's quarters, mud pumping facilities and the general means for maintaining an offshore position for at least a number of days while performing its drilling function.

A well head 21 positioned on the ocean floor forms the upper end of the well being drilled, and is provided with a pad or guide base 22 which supports guidelines to afford re-entry to the well bore. A blowout preventer or in the instance of a finished well, a valved Christmas tree arrangement, is in turn secured to guide base 22. In either case, marine riser 24 is normally provided with a movable connection 23 at the lower end thereof adapted to connect to the upper end of the blowout preventer stack or well head 21.

In the instance of a drilling operation, riser 24, also referred to as a mud or drilling riser, pivotally or rotatably engages the well head at pivotal joint 23. Further, it extends upwardly toward the drilling vessel 10 terminating near the underside of the upper deck of the latter. Functionally, mud riser 24 receives a flow of mud from pumps positioned on the vessel 10 such that the mud can be circulated down the drill string and up the riser to cool the drill string, clear away chips and lubricate the operation in general. Structurally, mud riser 24 includes a slip joint 26 comprising upper and lower telescopically arranged members which are so interconnected as to permit a vertical movement therebetween while at the same time maintaining a sealed segment therebetween against loss of pressure.

The upper end of riser 24 is similarly connected at a pivotal joint 27 to the deck 18. Therefore, considering the entire arrangement, mud riser 24 comprises a tubular member 12 to 24 inches in diameter which is pivotally connected at the respective ends thereof to vessel 10 and to the blowout preventer or well head 21. It is appreciated, therefore, that there is an inbuilt tolerance to movement between the vessel 10 and the ocean floor which is to be expected under ordinary drilling situations. Thus, as vessel 10 is displaced either laterally or vertically from its stable position, mud riser 24 will pivot about its upper and lower connecting joints 27 and 23 respectively to maintain the connection therebetween, and yet permit the above noted deviation of the vessel from its proper vertical location.

As mentioned herein, it is found advisable, if not essential, to apply a considerable amount of tension to riser 24 during the drilling operation. This requirement increases as the water depth increases. The apparatus 30 for applying such tension is rather complicated and will be shown here schematically. The equipment includes in brief, means such as cables 31 and 32 or the like which are attached to the lower end of the telescoping joint of riser 24. The cables are then directed to the necessary pulleys, guides or the like to a wind-up mechanism. The latter consists of means to pay out or take in on the respective cables while maintaining a constant tension thereon, all in response to the particular movements of the vessel.

Such tensioning mechanisms 30 are commercially available to perform the function noted and are actuated or programmed to permit a rapid response to the movement of vessel 10 whereby to maintain the desired riser tensioning condition.

The riser 24 itself comprises a series of tubular members which are connected end to end, whereby to form a closed cylindrical unit. The length of the riser is of course, a function of the depth of water in which vessel 10 is operating. This depth has a notable effect on the tension which must be maintained on riser 24 and hence affects the stresses to which the riser is subjected.

More particularly, in relatively shallow water depths, and mild environments, riser 24 can be maintained safe under a minimal degree of tension. In harsh environments, particularly in water depths greater than 500 or 600 feet, the riser is subjected to considerably greater externally induced stresses and strains by waves and currents and therefore must have much greater tension applied to maintain safe working stresses.

To reduce the stresses in riser 24, and thereby avoid its breakage or damage during high wave situations and to increase the water depth at which existing tensioning devices can operate, the semisubmersible vessel 10 is adapted to include in essence an elongated caisson 36 which extends from the lower deck 37 of the vessel, downwardly a predetermined distance to essentially the lowest elevation of the vessel. Caisson 36 will thereby enclose an elongated area of protected water therein. The upper end of caisson 36 is fixedly positioned to the lower side of deck 18 beneath the rotary table such that the drill string will pass concentrically therethrough. The lower end of caisson 36 is opened and communicated with the water.

Figure 2:
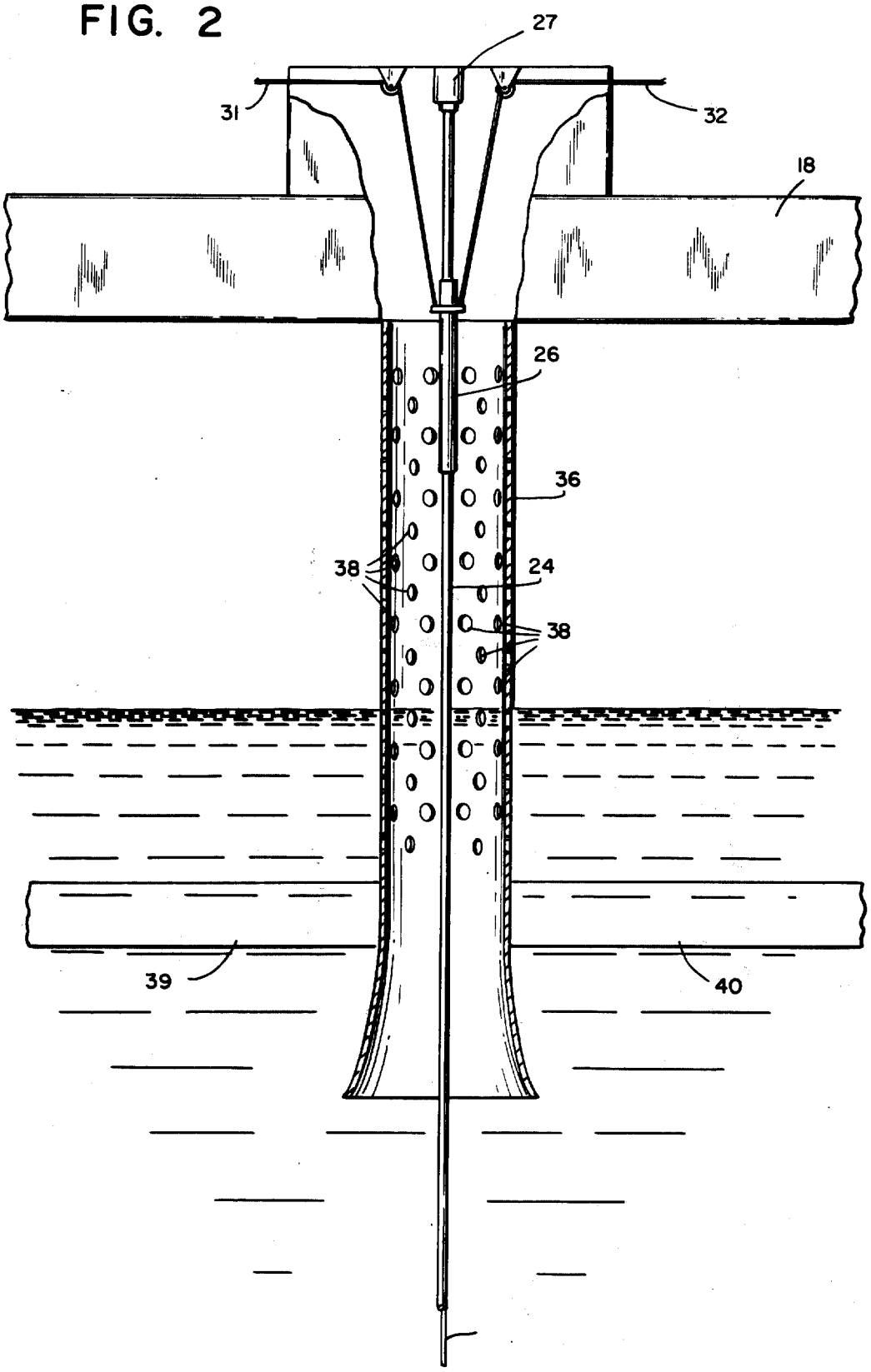
FIG. 2 is a segmentary view on an enlarged scale of a portion of the vessel shown in FIG. 1.

With the riser 24 passing downward through caisson 36, it can be seen particularly from FIG. 2, that the caisson 36 forms an elongated protected longitudinal area about the upper end of the riser. This protection extends both above and below the water's surface which, as herein noted, is subjected to the maximum wave and current forces. As caisson 36 is extended downwardly to a greater depth, riser 24 will be protected to a larger degree.

Caisson 36 can be externally braced horizontally near its lower end as shown in FIGS. 1 and 2, by structural members 39 and 40. This bracing can be achieved by connection along the length thereof to adjacent structural members of vessel 10, particularly at the lower parts of the latter.

To permit the mud riser 24 to assume a predetermined curve a vessel 10 is displaced, the lower end of caisson 36 is preferably outwardly divergent or flared toward the lower end thereof. Thus, if contact is made between the inner walls of the caisson and the riser 24, there will be no areas of concerted stress. Rather, the riser will assume a gradual curve corresponding to the curvature of the caisson lower end.

The latter can be provided with slots, perforations, or similar openings 38 in the upper end thereof which will permit free, though constricted passage of water therethrough thereby reducing the wave and current forces imposed on the caisson and avoiding amplification of waves within the caisson.

Functionally, as drilling vessel 10 is subjected to high waves and wind conditions the waves will tend to pass through the vessel without meeting substantial resistance imposed by the various upright columns 16 and 17. In a similar manner the central caisson 36 will afford a minimal amount of resistance to the wave movement. However, the lateral force which is exerted by the moving wave is readily absorbed in its entirety by the caisson so as to partially deflect the water thereabout; thus the mud riser 24 is not exposed to the high wave and current forces which persist in the wave's upper zone.

Figure 4:
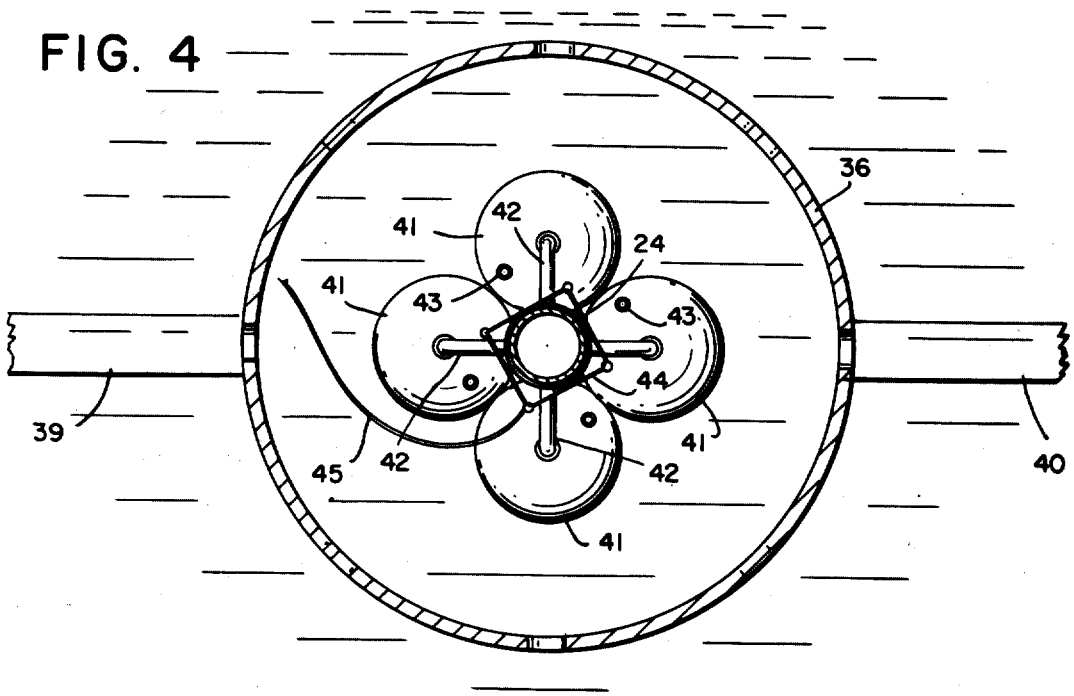
FIG. 4 is an enlarged cross-sectional view taken along line 4—4 of FIG. 3.
Figure 3:
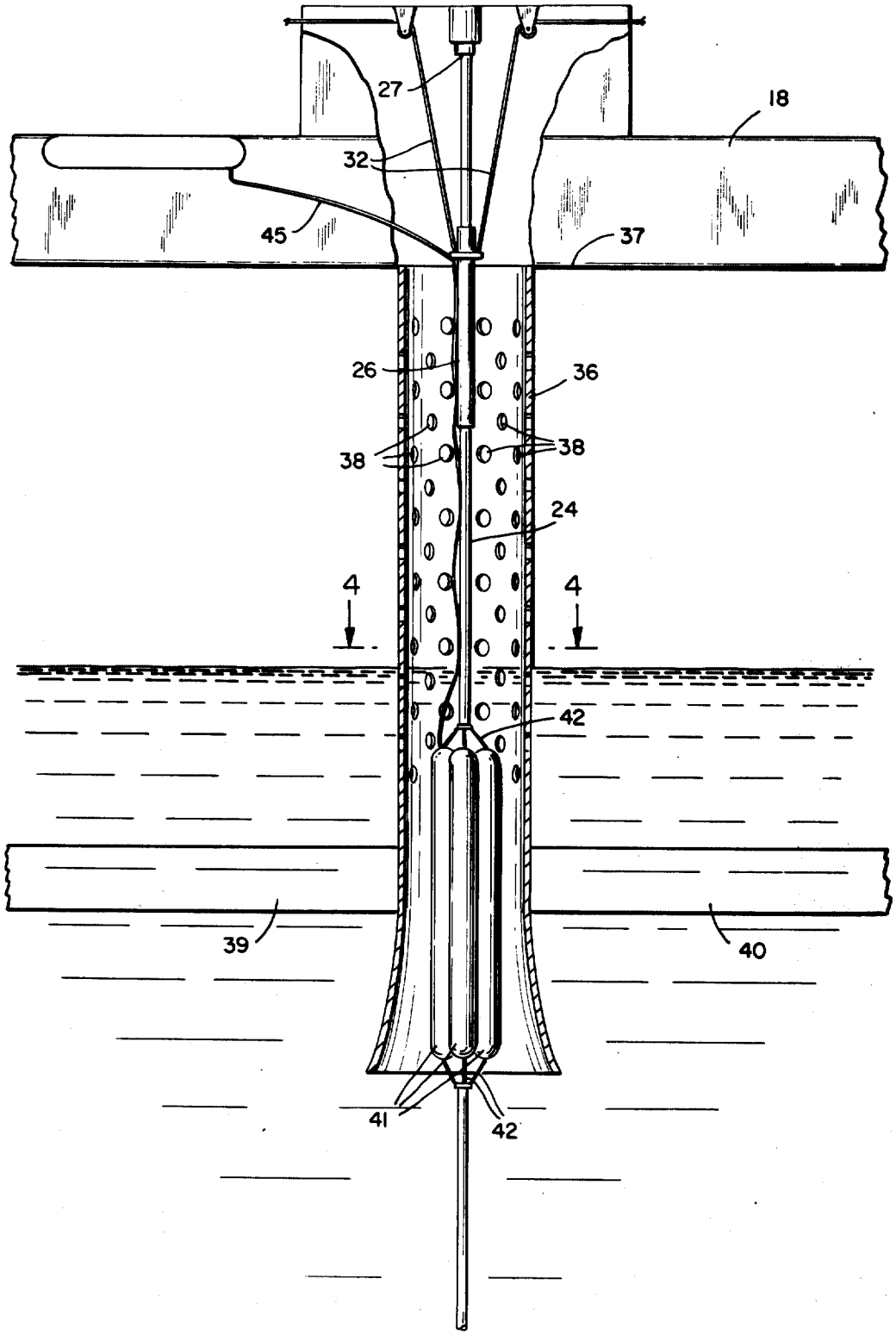
FIG. 3 is similar to FIG. 2 illustrating the riser as supported from a drilling vessel having buoyancy means attached to the riser.

An alternate embodiment of the disclosed operation, which is intended to either further reduce the need for mechanical tensioning devices or in conjunction with conventional mechanical tensioners, to extend water depth capability of existing drilling and production risers, is shown in FIGS. 3 and 4. Caisson 36 encloses riser 24. At least two, and preferably a plurality of flexible walled rubber fabric tanks 41 are secured to riser 24 to form a resilient collar about the riser by cable connectors 42. Tanks 41 could be elongated cylindrical shapes designed to provide the desired amount of buoyancy for lifting riser 24. Each buoyancy tank 41 is desirably equipped with a pressure relief valve 43 or similar means to prevent over-inflating the tanks. Likewise, each tank is communicated with a manifold 44 near the tank top. Thus, the latter can be pressurized or deflated through a common line 45 leading to a control system and an air receiver on board the drilling vessel.

Figure 5:
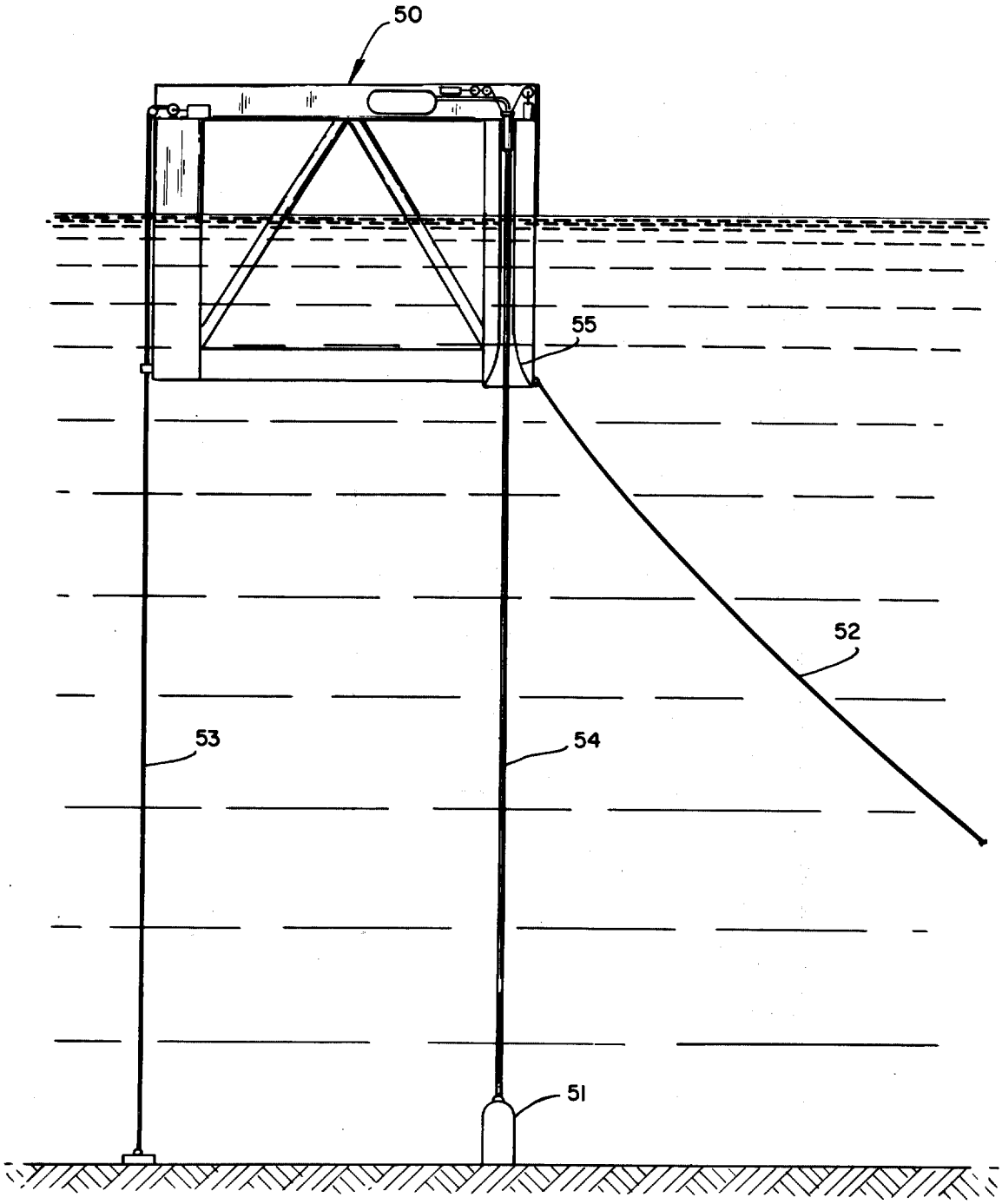
FIG. 5 is an alternate embodiment of the system shown in FIG. 1.

In the instance of a production riser, where it may not be necessary to bring the riser 24 aboard the vessel 10 near the center of the vessel, the riser protector caisson 36 could be enclosed in one or more of the vertical legs of vessel. As shown in the embodiment of FIG. 5, a semisubmersible vessel is composed of a tension leg production platform 50 maintained on location over a subsea well or manifold 51 by either conventional catenary mooring lines 52 or vertical lines 53 in the case of the tension leg platform. In either instance, riser 54 extends from well 51, through protective caisson enclosure 55 built into one or more of the upstanding legs of platform 50. Since only a riser pipe must be run through caisson 55, the latter can be reduced considerably in size compared to the drilling riser.

Caisson 55, similar to caisson 36, is outwardly flared at the lower end and of sufficient diameter to receive riser 54. Thus, the latter will be protected from the lateral forces exerted by storm induced waves.

Other modifications and variations of the invention as hereinbefore set forth may be made without departing from the spirit and scope thereof, and therefore, only such limitations should be imposed as are indicated in the appended claims.

I claim:

1. The combination with a semisubmersible drilling vessel adapted for operating in an offshore body of water, said vessel having a work deck supported above the water's surface by a plurality of substantially vertically disposed upright columns which are spaced apart to permit passage of water and waves therebetween when said vessel is floatably stationed at an offshore working site, a drill string riser depending from said vessel and extending to the floor of said body of water to accommodate a drill string therethrough, of;

shielding means surrounding the upper end of said drill string riser to protect the latter from contact with waves which pass through said spaced apart support legs, which shielding means comprises;

an elongated open ended caisson depending downwardly from said vessel to a sufficient water depth, and being spaced outwardly from the said riser to define an annular space therebetween whereby to form a protective zone about said drill string riser upper end, said elongated caisson having a series of perforations formed in the walls thereof to permit passage of water therethrough and to maintain the water level within said caisson consistent with the level of water external thereto.

2. In the apparatus as defined in claim 1, wherein said elongated open ended caisson includes an outwardly flared section.

3. In the apparatus as defined in claim 1, wherein said elongated open ended caisson lower end is outwardly divergent to define a profile of such curvature to avoid damage to said drill string riser when the vessel is displaced through wave action.

4. In the apparatus as defined in claim 1, including lateral bracing means engaging said vessel to said elongated open ended caisson at longitudinally spaced positions along the open ended caisson.

5. In the apparatus as defined in claim 1, wherein said drill string riser is operably connected at opposed ends thereof to said vessel and to the ocean floor respectively.

6. In the apparatus as defined in claim 5, including means connected to said drill string riser to apply a tensional force to the riser.

7. In the apparatus as defined in claim 1, wherein said open ended elongated caisson is of a generally cylindrical cross-section.

8. In the apparatus as defined in claim 1, wherein said vessel is a tension leg platform.

9. In the apparatus as defined in claim 1, including means forming a resilient collar carried on said drill string riser and extending outwardly from the latter to contact the inner walls of said caisson when said riser is laterally deflected with respect to the caisson.

10. In the apparatus as defined in claim 9, wherein said resilient collar includes at least one elongated, flexible walled tank carried on said riser within said annular space, and extending longitudinally thereof.

11. In the apparatus as defined in claim 9, wherein said resilient collar includes a plurality of elongated, flexible walled tanks disposed about said riser, each of said tanks extending outwardly toward the inner wall of said caisson.

* * * * *